US009590377B2

(12) United States Patent
Jol

(10) Patent No.: US 9,590,377 B2
(45) **Date of Patent: *Mar. 7, 2017**

(54) HEAT SEALED CONNECTOR ASSEMBLY

(71) Applicant: Apple Inc., Cupertino, CA (US)

(72) Inventor: Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 73 days.

This patent is subject to a terminal disclaimer.

(21) Appl. No.: 14/160,288

(22) Filed: Jan. 21, 2014

(65) Prior Publication Data

US 2014/0196830 A1 Jul. 17, 2014

Related U.S. Application Data

(63) Continuation of application No. 12/984,241, filed on Jan. 4, 2011, now Pat. No. 8,632,363.
(Continued)

(51) Int. Cl.

| | |
|---|---|
| ***H01R 13/648*** | (2006.01) |
| ***H01R 43/00*** | (2006.01) |
| ***G09F 9/35*** | (2006.01) |
| ***H01R 13/24*** | (2006.01) |
| ***H01R 13/504*** | (2006.01) |
| ***H01R 13/52*** | (2006.01) |
| ***H01R 13/6582*** | (2011.01) |
| ***H01R 13/6594*** | (2011.01) |
| ***H01R 24/60*** | (2011.01) |
| ***H01R 24/78*** | (2011.01) |
| ***H01R 43/02*** | (2006.01) |

(Continued)

(52) U.S. Cl.
CPC ..... *H01R 43/005* (2013.01); *G09F 9/35* (2013.01); *H01R 13/2414* (2013.01); *H01R 13/504* (2013.01); *H01R 13/5202* (2013.01); *H01R 13/5216* (2013.01); *H01R 13/6582* (2013.01); *H01R 13/6594* (2013.01); *H01R 24/60* (2013.01); *H01R 24/78* (2013.01); *H01R 43/0221* (2013.01); *H01R 4/4809* (2013.01); *H01R 12/722* (2013.01); *H01R 13/187* (2013.01); *H01R 13/6273* (2013.01); *H01R 2107/00* (2013.01); *Y10T 29/49117* (2015.01); *Y10T 156/10* (2015.01)

(58) Field of Classification Search
CPC ..... H01R 13/6581
USPC ..... 439/607.4, 607.17
See application file for complete search history.

(56) References Cited

U.S. PATENT DOCUMENTS 3,914,502 A 10/1975 Hayashi et al.
5,151,327 A 9/1992 Nishiyama et al.
(Continued)

FOREIGN PATENT DOCUMENTS

CN 1111832 11/1995
CN 1099728 1/2003
(Continued)

*Primary Examiner* — Phuong Dinh
(74) *Attorney, Agent, or Firm* — Kilpatrick Townsend & Stockton LLP

(57) ABSTRACT

Heat sealing a connector assembly can be performed by providing connector assembly in component accessible state, overlaying sealing tape on electrical contacts and housing, sealing tape being impregnated with heat sensitive adhesive, the overlaying leaving the dimples exposed, and sealing the connector assembly by applying heat to heat sensitive sealing tape.

18 Claims, 12 Drawing Sheets

Related U.S. Application Data

(60) Provisional application No. 61/378,843, filed on Aug. 31, 2010.

(51) Int. Cl.

| | |
|---|---|
| *H01R 4/48* | (2006.01) |
| *H01R 12/72* | (2011.01) |
| *H01R 13/187* | (2006.01) |
| *H01R 13/627* | (2006.01) |
| *H01R 107/00* | (2006.01) |

(56) References Cited

U.S. PATENT DOCUMENTS

| | | | | |
|---|---|---|---|---|
| 5,427,535 | A | 6/1995 | Sinclair | |
| 5,546,654 | A | 8/1996 | Wojnarowski et al. | |
| 5,596,170 | A * | 1/1997 | Barina | H01R 13/2407 174/366 |
| 5,967,846 | A | 10/1999 | Davis et al. | |
| 5,975,957 | A * | 11/1999 | Noda | H01R 13/65802 439/607.17 |
| 6,171,138 | B1 | 1/2001 | Lefebvre et al. | |
| 6,369,323 | B1 * | 4/2002 | Wright | H01R 4/64 174/40 CC |
| 6,426,138 | B1 | 7/2002 | Narushima et al. | |
| 6,733,339 | B2 | 5/2004 | Casey | |
| 6,930,734 | B2 | 8/2005 | Lee | |
| 7,114,245 | B2 | 10/2006 | Ogimoto | |
| 7,182,118 | B2 | 2/2007 | Cheung et al. | |
| 7,186,038 | B2 | 3/2007 | Hovland et al. | |
| 7,208,819 | B2 | 4/2007 | Jeun et al. | |
| 7,435,110 | B2 | 10/2008 | Xiao et al. | |
| 7,455,915 | B2 | 11/2008 | Johnson | |
| 7,551,448 | B2 | 6/2009 | Roberts | |
| 7,568,844 | B2 | 8/2009 | Luther et al. | |
| 7,697,281 | B2 | 4/2010 | Dabov et al. | |
| 7,841,910 | B2 | 11/2010 | Fields et al. | |
| 8,472,203 | B2 | 6/2013 | Dabov et al. | |
| 8,492,661 | B2 * | 7/2013 | Jol | H01R 13/521 174/50 |
| 8,537,543 | B2 | 9/2013 | Wang et al. | |
| 8,564,119 | B2 | 10/2013 | Eichelberger et al. | |
| 8,632,363 | B2 * | 1/2014 | Jol | H01R 43/0221 439/607.17 |
| 9,028,269 | B2 * | 5/2015 | Hsu | H01R 13/518 439/357 |
| 2008/0191174 | A1 | 8/2008 | Ehrensvard et al. | |
| 2009/0033826 | A1 | 2/2009 | Shimizu | |

FOREIGN PATENT DOCUMENTS

| | | |
|---|---|---|
| CN | 2932689 | 8/2007 |
| CN | 101667694 | 3/2010 |
| CN | 201491423 | 5/2010 |
| CN | 201498790 U | 6/2010 |
| EP | 1052738 | 11/2000 |
| EP | 2178020 | 4/2010 |
| WO | WO 95/13315 | 5/1995 |
| WO | WO 00/77887 | 12/2000 |

* cited by examiner

HEAT SEALED CONNECTOR ASSEMBLY

CROSS REFERENCE TO RELATED APPLICATIONS

This application is a continuation of U.S. patent application Ser. No. 12/984,241, entitled "Heat Sealed Connector Assembly," filed on filed Jan. 4, 2011, which claims priority under 35 U.S.C. 119(e) to U.S. Provisional Application entitled "Heat Sealed Connector Assembly," having Application Ser. No. 61/378,843 and filed Aug. 31, 2010, both of which are incorporated by reference in their entirety as if fully disclosed herein.

TECHNICAL FIELD

The described embodiments relate generally to small form factor electronic devices. More particularly, providing grounding support for a connector is described.

DESCRIPTION OF THE RELATED ART

The outward appearance of a small form factor electronic device, including its design and its heft can be important factors in determining a user's overall appreciation of the product. For example, the outward appearance and perceived quality of the device functionality can contribute to the overall impression that the user has of the small form factor electronic device. At the same time, the assembly of the small form factor electronic device is also an important consideration as a durable assembly helps to extend the overall life of the small form factor electronic device thereby increasing its value to the user.

One design challenge associated with the small form factor electronic device is the design of the enclosures used to house the various internal components. This design challenge generally arises from a number conflicting design goals that includes the desirability of making the enclosure lighter and thinner, the desirability of making the enclosure stronger and making the enclosure more esthetically pleasing. The lighter enclosures, which typically use thinner plastic structures and fewer fasteners, tend to be more flexible and therefore they have a greater propensity to buckle and bow when used while the stronger and more rigid enclosures, which typically use thicker plastic structures and more fasteners, tend to be thicker and carry more weight. Unfortunately, increased weight can lead to user dissatisfaction, and bowing can damage the internal parts.

The shape of the housing can also be such that the housing easily fits into a user's hand. This shape can be challenging when attempting to provide openings used to accommodate input/output devices such as connectors, audio ports, etc.

Therefore providing suitable openings in a highly curved housing used to support a small form factor electronic device is desirable.

SUMMARY OF THE DESCRIBED EMBODIMENTS

A method for heat sealing an electrical connector assembly is described. In the embodiment, the electrical connector assembly includes a plurality of electrical contacts each having a flat pad portion and an upraised portion in the form of a dimple, at least one window bracket arranged to engage a corresponding latch on a plug when the plug is inserted and engaged with the electrical connector assembly. The method can be carried out by performing at least the following operations. Providing the connector assembly in component accessible state, providing sealing tape, the sealing tape comprising a thin film impregnated with a heat sensitive adhesive, overlaying the housing and the flat pad portion of at least some of the electrical contacts with the sealing tape leaving at least some of the dimples substantially exposed, applying an amount of heat to the sealing tape, the amount of heat sufficient to liquefy the heat sensitive adhesive such that the liquefied adhesive flows over a surface of the housing and the plurality of electrical contacts, wherein the dimples remain exposed and sealing the electrical contact assembly by allowing the liquefied adhesive to cure.

An electrical connector assembly includes at least a plurality of electrical contacts each having a flat pad portion and an upraised portion in the form of a dimple, wherein at least one dimple is spring activated, the spring activated dimple forming an EMI ground tab and a metal housing, the metal housing laser welded to bracket using at least one exposed dimple as a laser target.

A moisture sealed electrical connector assembly includes a plurality of electrical contacts exposed to an external environment where each of the plurality of electrical contacts has a flat pad portion and an upraised portion in the form of a dimple and at least one dimple is spring activated forming an EMI ground tab. The electrical connector assembly also includes a bracket arranged to engage an associated latch on a connector plug when the connector plug is inserted into and engages the electrical connector assembly. The electrical connector assembly is heat sealed using sealing tape overlaying the housing, the flat pad portion of at least some of the electrical contacts and at least a portion of the dimples, leaving an upper part of the dimples remains exposed.

In one aspect, a metal housing is laser welded to the bracket using at least one exposed dimple as a laser target. In this way, the sealing tape prevents moisture passing from the external environment via the electrical contacts to the interior of the device housing thereby protecting the operational components from moisture related contamination.

A method of preventing moisture intrusion from an external environment into an interior of an electronic device having housing with an opening to the external environment is performed by carrying out the following operations. Providing a heat sealed electrical connector assembly. In the described embodiment, the heat sealed electrical connector assembly includes a plurality of electrical contacts at least a portion of which are exposed to the external environment where each of the electrical contacts are sealed to prevent the transport of moisture from the external environment to the interior of the electronic device. Placing the heat sealed electrical connector assembly within the opening and securing the heat sealed electrical connector assembly to the opening. In this way, the heat sealed electrical connector assembly substantially prevents moisture from passing from the exterior environment to the interior of the electronic device.

Other apparatuses, methods, features and advantages of the described embodiments will be or will become apparent to one with skill in the art upon examination of the following figures and detailed description. It is target that all such additional apparatuses, methods, features and advantages be included within this description be within the scope of and protected by the accompanying claims.

BRIEF DESCRIPTION OF THE DRAWINGS

The described embodiments and the advantages thereof can best be understood by reference to the following description taken in conjunction with the accompanying drawings.

DETAILED DESCRIPTION OF REPRESENTATIVE EMBODIMENTS

Figure 1:
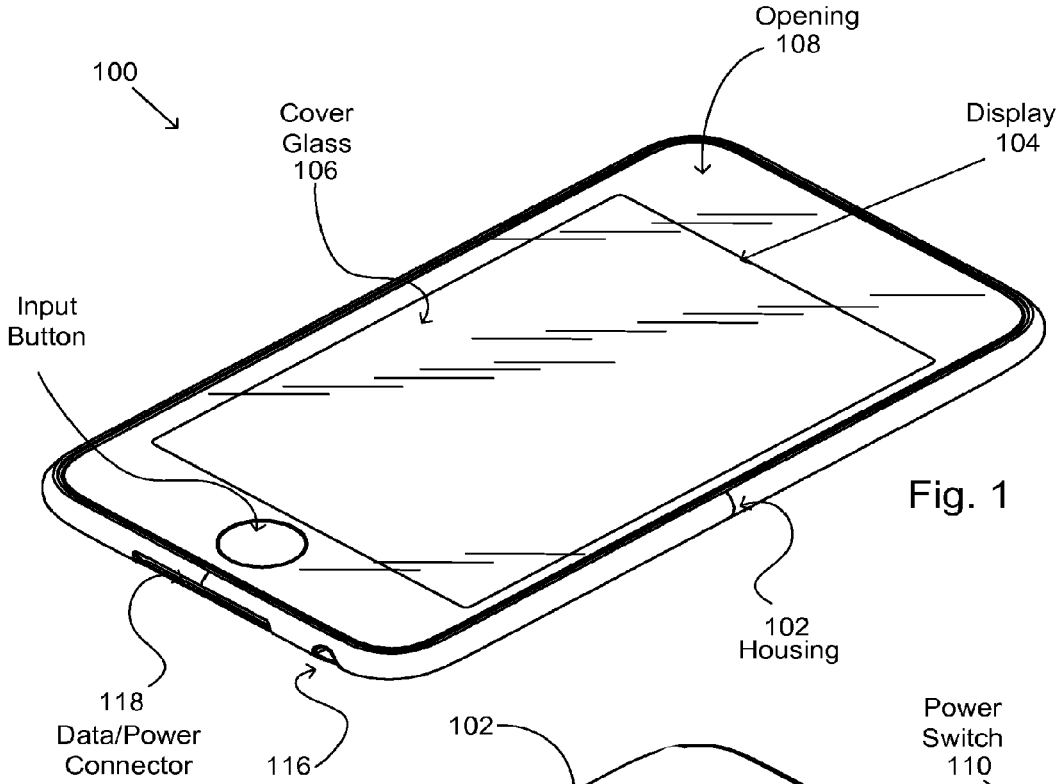
FIGS. 1-2 are perspective diagrams showing various views of fully assembled personal media device in accordance with an embodiment of the invention.

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

Aspects of the described embodiments relate to a small form factor electronic product. For the remainder of this discussion, the small form factor electronic device will be described in terms of a personal media device. The personal media device can include housing suitable for enclosing and supporting various operational components. The housing can support various input/output mechanisms such as volume switches, power buttons, data and power connectors, audio jacks and the like. The housing can include openings to accommodate the input/output mechanisms. The locations at which the input/output mechanisms are placed can be selected to enhance the usability of the interface under conditions for which the device is intended to operate. For instance, for a device intended to be operated with a single hand, the input mechanisms, such as an audio control switch, can be placed at a location that are easily finger operated while the device is held in the palm of the hand. Other output mechanisms, such as an audio jack, can be placed at locations that do not interfere with holding the device, such as on a top edge of the device.

Device components that connect to and allow the personal media device to operate for its intended functions can be packaged within the enclosure. Some flexibility can be afforded in regards to the locations of the internal device components as long as sufficient space for needed connectors between components is available. Also, approaches, such as custom-shaped printed circuit boards (PCBs) or batteries can be employed to allow available internal spaces to be efficiently utilized. A connector assembly used to accommodate the connector port can be widely varied. For example, the connector assembly can take the form of a data/power connector (such as a standard 30 pin type connector). The connector assembly can also be associated with an output device such as an audio jack having an audio jack barrel with a size and shape in accordance with an audio post. The audio post can be inserted into the audio jack barrel. In this way electrical contacts on the audio post engage corresponding contact pads on an interior surface of the audio jack barrel allowing electrical signals to pass between an external circuit (such as headphones) and the personal media device. Typically, when the audio post is inserted into the audio jack barrel, the acoustic speakers are disabled such that the insertion of the audio jack into the audio jack barrel does not interfere with the outputting of audible sound.

These and other embodiments are discussed below with reference to FIGS. 1-12. However, those skilled in the art will readily appreciate that the detailed description given herein with respect to these figures is for explanatory purposes only and should not be construed as limiting.

Figure 2:
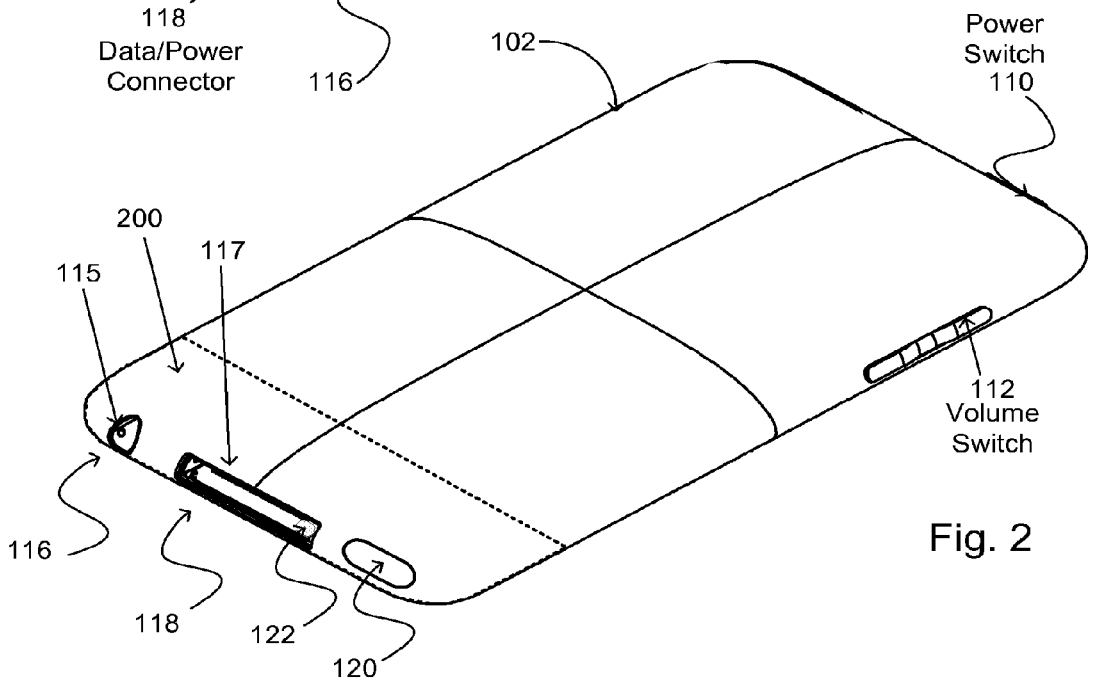

FIGS. 1-2 are perspective diagrams showing various views of fully assembled personal media device 100 in accordance with an embodiment of the invention. Personal media device 100 can be sized for one-handed operation and placement into small areas such as a pocket, i.e., personal media device 100 can be a handheld pocket sized electronic device. By way of example, personal media device 100 can correspond to a computer, media device, telecommunication device and/or the like. Personal media device 100 is capable of processing data and more particularly media such as audio. Personal media device 100 can generally correspond to a music player, game player, video player, personal digital assistant (PDA), and/or the like. With regards to being handheld, personal media device 100 can be operated solely by the user's hand(s), i.e., no reference surface such as a desktop is needed. In some cases, the handheld device is sized for placement into a pocket of the user. By being pocket sized, the user does not have to directly carry the device and therefore the device can be taken almost anywhere the user travels (e.g., the user is not limited by carrying a large, bulky and heavy device).

Personal media device 100 can be widely varied. In some embodiments, personal media device 100 can perform a single function (e.g., a device dedicated to playing and storing media) and, in other cases, the personal media device can perform multiple functions (e.g., a device that plays/stores media, receives/transmits telephone calls/text messages/internet, and/or performs web browsing). Personal media device 100 is capable of communicating wirelessly (with or without the aid of a wireless enabling accessory system) and/or via wired pathways (e.g., using traditional electrical wires). In some embodiments, personal media device 100 can be extremely portable (e.g., small form factor, thin, low profile, lightweight). Personal media device 100 can even be sized for one-handed operation and placement into small areas such as a pocket, i.e., personal media device 100 can be a handheld pocket sized electronic device. Personal media device 100 can correspond to any of those electronic devices an iPod™, or an iPhone™ available by Apple Inc. of Cupertino, Calif.

Personal media device 100 can include housing 102 configured to at least partially enclose any suitable number of components associated with personal media device 100. For example, housing 102 can enclose and support internally various electrical components (including integrated circuit chips and other circuitry) to provide computing operations for the device. The integrated circuit chips and other circuitry can include a microprocessor, memory, a battery, a circuit board, I/O, various input/output (I/O) support circuitry and the like. Although not shown in this figure, housing 102 can define a cavity within which the components can be positioned and housing 102 also can physically support any suitable number of mechanisms, within housing 102 or within openings through the surface of housing 102.

In addition to the above, housing 102 can also define at least in part the outward appearance of personal media device 100. That is, the shape and form of housing 102 can help define the overall shape and form of personal media device 100 or the contour of housing 102 can embody the outward physical appearance of personal media device 100. Any suitable shape can be used. In some embodiments, the size and shape of housing 102 can be dimensioned to fit comfortably within a user's hand. In some embodiments, the shape includes a slightly curved back surface and highly curved side surfaces. Housing 102 is integrally formed in such a way as to constitute is a single complete unit. By being integrally formed, housing 102 has a seamless appearance unlike conventional housings that include two parts that are fastened together thereby forming a reveal, a seam there between. That is, unlike conventional housings, housing 102 does not include any breaks thereby making it stronger and more aesthetically pleasing. Housing 102 can be formed of any number of materials including for example plastics, metals, ceramics and the like. In one embodiment, housing 102 can be formed of stainless steel in order to provide an aesthetic and appealing look and feel as well as provide structural integrity and support for all sub-assemblies installed therein. When metal, housing 102 can be formed using conventional collapsible core metal forming techniques well known to those skilled in the art.

Personal media device 100 also includes cover 106 that includes a planar outer surface. The outer surface can for example be flush with an edge of the housing wall that surrounds the edge of the cover. Cover 106 cooperates with housing 102 to enclose personal media device 100. Although cover 106 can be situated in a variety of ways relative to the housing, in the illustrated embodiment, cover 106 is disposed within and proximate the mouth of the cavity of housing 102. That is, cover 106 fits into an opening 108. In an alternate embodiment, cover 106 can be opaque and can include touch sensing mechanism that forms a touch pad. Cover 106 can be configured to define/carry the user interface of personal media device 100. Cover 106 can provide a viewing region for display assembly 104 used to display a graphical user interface (GUI) as well as other information to the user (e.g., text, objects, and graphics). Display assembly 104 can be assembled and contained within housing 102. Such user input events can be used for any number of purposes, such as resetting personal media device 100, selecting between display screens presented on display assembly 104, and so on. In one embodiment, cover 106 is a protective top layer of transparent or semitransparent material (clear) such that display assembly 104 is visible there-through. That is, cover 106 serves as a window for display assembly 104 (i.e., the transparent cover overlays the display screen). In one particular embodiment, cover 106 is formed from glass (e.g., cover glass), and more particularly highly polished glass. It should be appreciated, however, that other transparent materials such as clear plastic can be used.

The viewing region can be touch sensitive for receiving one or more touch inputs that help control various aspects of what is being displayed on the display screen. In some cases, the one or more inputs can be simultaneously received (e.g., multi-touch). In these embodiments, a touch sensing layer (not shown) can be located below the cover glass 106. The touch sensing layer can for example be disposed between the cover glass 106 and the display assembly 104. In some cases, the touch sensing layer is applied to display assembly 104 while in other cases the touch sensing layer is applied to the cover glass 106. The touch sensing layer can for example be attached to the inner surface of the cover glass 106 (printed, deposited, laminated or otherwise bonded thereto). The touch sensing layer generally includes a plurality of sensors that are configured to activate as the finger touches the upper surface of the cover glass 106. In the simplest case, an electrical signal is produced each time the finger passes a sensor. The number of signals in a given time frame can indicate location, direction, speed and acceleration of the finger on the touch sensitive portion, i.e., the more signals, the more the user moved his or her finger. In most cases, the signals are monitored by an electronic interface that converts the number, combination and frequency of the signals into location, direction, and speed and acceleration information. This information can then be used by the personal media device 100 to perform the desired control function relative to display assembly 104.

Personal media device 100 can also include one or more switches including power switches, volume control switches, user input devices and the like. Power switch 110 can be configured to turn personal media device 100 on and off, whereas volume switches 112 is configured to modify the volume level produced by the personal media device 100. Personal media device 100 can also include one or more connectors for transferring data and/or power to and from personal media device 100. For example, opening 115 can accommodate audio jack 116 whereas opening 117 can accommodate data/power connector 118. Audio jack 116 allows audio information to be outputted from personal media device 100 by way of a wired connector whereas connector 118 allows data to be transmitted and received to and from a host device such as a general purpose computer (e.g., desktop computer, portable computer). Connector 118 can be used to upload or down load audio, video and other image data as well as operating systems, applications and the like to and from personal media device 100. For example, connector 118 can be used to download songs and play lists, audio books, photos, and the like into the storage mechanism (memory) of personal media device 100. Connector 118 also allows power to be delivered to personal media device 100.

Portion 200 of personal media device 100 can include a number of communication features. For example, portion 200 can include at least first audio port 120 that can be used to output a first portion of audible sound generated by an audible sound generator assembly enclosed within housing 102. The audible sound generator assembly can take many forms. In the described embodiment, however, the audible sound generator assembly includes at least a diaphragm arranged to synchronously vibrate with audio signals provided by a processing unit included in personal media device 100. The audio signals can be provided by the processing unit decoding audio data files retained within personal media device 100. Enclosed within connector assembly 118, second audio port 122 can be used to output a remaining portion of the audible sound generated by the audible sound generator assembly. In this way, first audio port 120 and second audio port 122 can cooperatively output the audible sound generated by the audible sound generator assembly. By cooperative it is meant that when, for example, first audio port 120 is blocked or otherwise obstructed (by a finger, clothing, etc.), the placement of second audio port 122 substantially precludes the likelihood that second audio port 122 will also be blocked. Therefore, since first audio port 120 and second audio port 122 share an air path from the audible sound generator to the external environment, when one portion of the air path (that portion associated with first audio port 120, for example) is blocked or otherwise obstructed, at least some of the first portion of audible sound generated by the audible sound generator assembly can be passively re-directed to second audio port 122 thereby substantially preserving an overall perceived sound output level.

Figure 3:
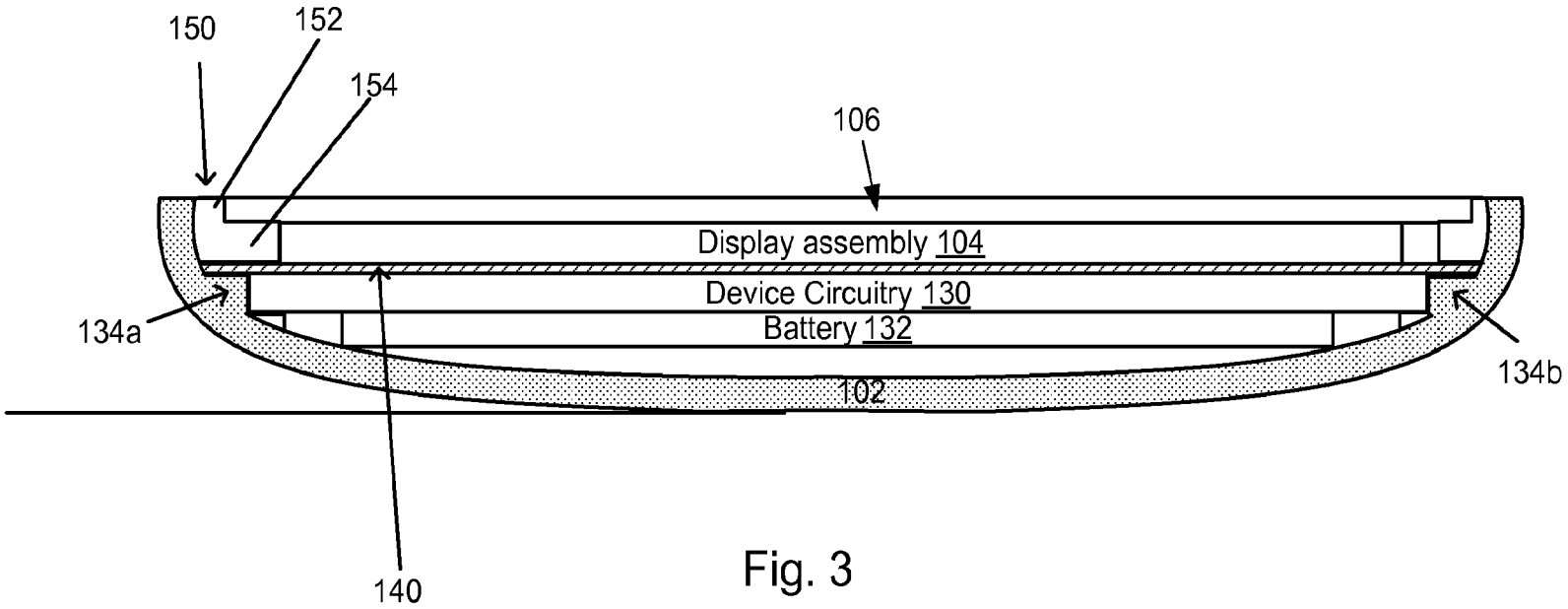
FIG. 3 is a side view of personal media device in accordance with the described embodiments.

FIG. 3 shows a cross-sectional view of a portable electronic device 100 shown in FIGS. 1-2. Housing 102 can enclose various internal device components such as those associated with the user interface that allow personal media device 100 to operate for its intended functions. For the purposes of discussion, the internal device components can be considered to be arranged in a number of stacked layers. For example, a display screen of the display assembly 104 can be located directly below the top glass 106. In one embodiment, the display screen and its associated display driver circuitry can be packaged together as part of the display assembly 104. Below display assembly 104, device circuitry 130, such as a main logic board or circuitry associated with other components, and a battery 132, which provides power to personal media device 100, can be located.

Internal frame 140 can add to the overall stiffness of personal media device 100 by, for example, enhancing an ability to resist bending moments experienced by housing 102. Internal frame 140 can be formed of many strong and resilient materials. For example when internal frame 140 is formed of metal such as stainless steel, internal frame 140 can be referred to as M (etal)-frame 140. M-frame 140 can provide both structural support for personal media device 100 but also act to aid in the transfer of heat generated by the various internal components to the external environment. M-frame 140 can be located below the display assembly 104 and above the device circuitry 130. In this way, M-frame 140 can provide support for various internal components as well as aid in transferring heat from internal components such as display assembly 104.

M-frame 140 can be used as an attachment point for other device components. For example, M-frame 140 can be attached to mounting surface, such as 134*a* and 134*b*, on housing 102 via fasteners or using a bonding agent. Then, other device components, such as display assembly 104 can be coupled to M-frame 140 rather than directly to housing 102. One advantage of coupling display assembly 104 to the housing via M-frame 140 is that display 140 can be somewhat isolated from bending moments associated with housing 102, i.e., bending moments generated on the housing can be dissipated into M-frame 140. Isolating the display assembly 104 from bending moments associated with housing 102 can prevent damage to display assembly 104, such as cracking, from occurring.

It should be noted that in some embodiments, personal media device 100 can include additional internal frames. For example, frame 150 can be affixed directly to housing 102 and generally may act to support top glass 106. In this regard, frame 150 can be referred to as G (lass)-frame 150. In order to support cover glass 106, G-frame 150 can include rim 152 having flange portion 154 where cover glass 106 is glued to rim 152 about flange 154, thus sealing the entire device. G-frame 150 can be made of an electrically non-conductive frame material, such as a glass filled plastic. One example glass-filled plastic suitable for use in G-frame 150 is KALIX™, manufactured by Solvay Advanced Polymers of Alpharetta, Ga. KALIX™. includes 50% glass-fiber reinforced high-performance nylon. One of ordinary skill in the art will recognize that there are many other potential frame materials that would be suitable for use with this embodiment, and the claims should not be construed as being limited to KALIX™ or any other glass-filled plastic unless expressly stated.

Figure 4:
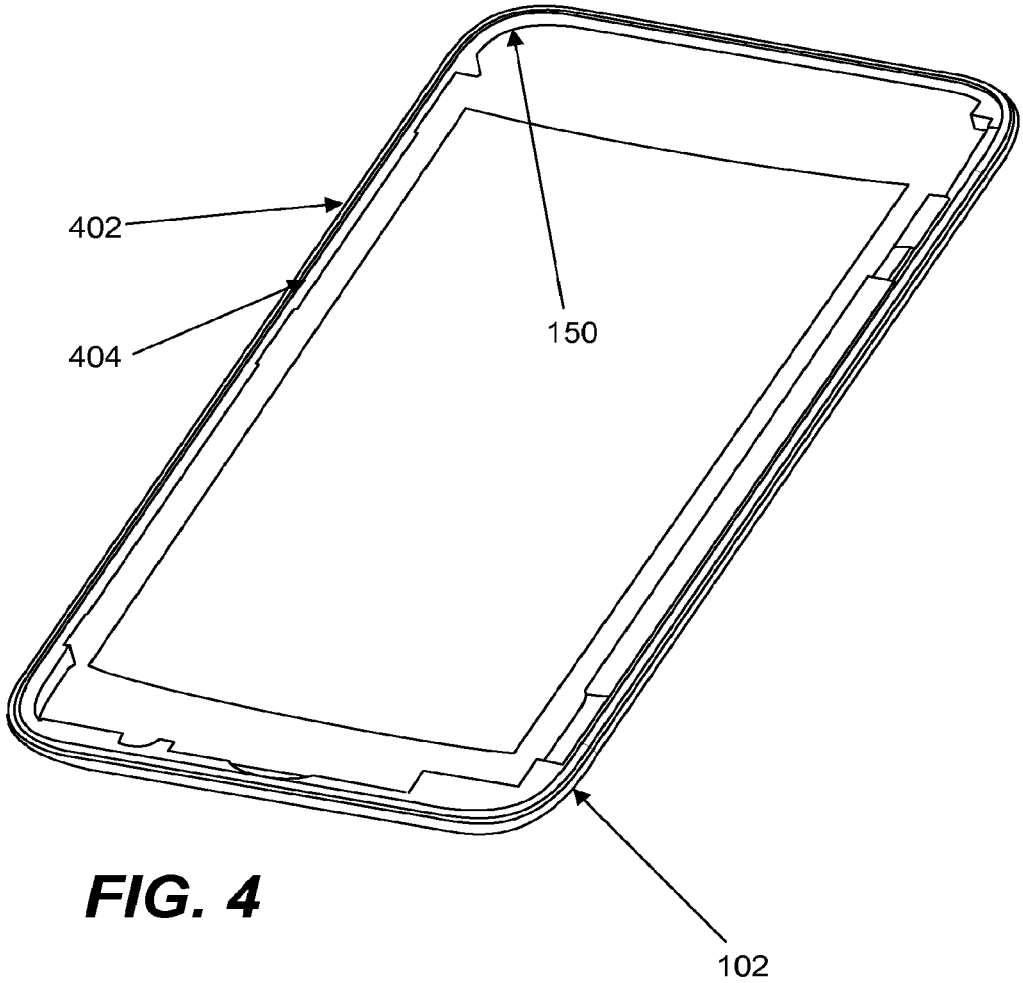
FIG. 4 shows a top view of interior of housing showing G-frame in more detail.

FIG. 4 shows a top view of interior of housing 102 showing G-frame 150 in more detail. Here, housing 102 is provided, which is made of an electrically conductive material. An example of an electrically conductive material suitable for use with this embodiment is stainless steel, although one of ordinary skill in the art will recognize that there are many other potential materials that would be suitable with this embodiment and the claims should not be construed as being limited to stainless steel unless expressly stated. G-Frame 150 is affixed to housing 102, and generally may act to support a front face (not pictured) of the device. The front face may be made of transparent material, such as glass, and may act to cover the device, yet permit a user to view through the cover to a display (not pictured) underneath. This display may also act as an input device. For example, the display may be one of many different types of touch screens. In order to support the cover, G-frame 150 may include rim 402 having flange portion 404. In one embodiment, the cover is glued to rim 402 about flange 404, thus sealing the entire device. Thus, rim 402 acts not only as a support for the cover but also as a junction area where the cover may be affixed to the frame.

Figure 5:
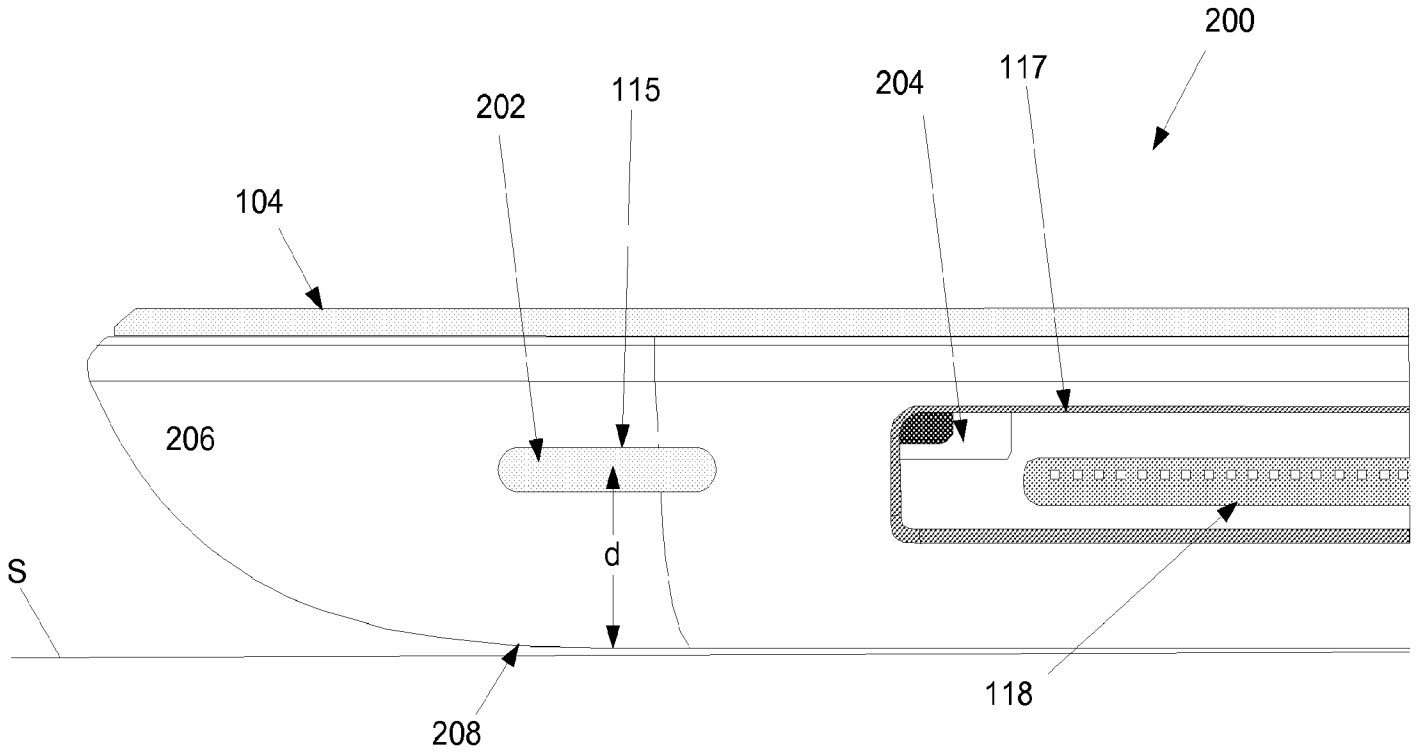
FIG. 5 shows an enlarged view of a portion of housing shown in FIG. 2 viewed in a head on perspective showing connector assembly in accordance with the described embodiments.

FIG. 5 shows an enlarged view of portion 200 of housing 102 shown in FIG. 2 viewed head on. For the remainder of this discussion and without loss of generality, first audio port 120 will be referred to as housing port 202 and second audio port 120 as connector port 204. Housing port 202 can have a size and shape in keeping with the overall shape and appearance of housing 102. For example, side walls 206 of housing 102 can have a spline, or curved shape that facilitates a user holding personal media device 100 in a hand. Accordingly, housing port 202 can be shaped to more readily blend in with the shape of sidewalls 206. Housing port 202 can be located distance "d" from rear surface 208 of housing 102.

Figure 6:
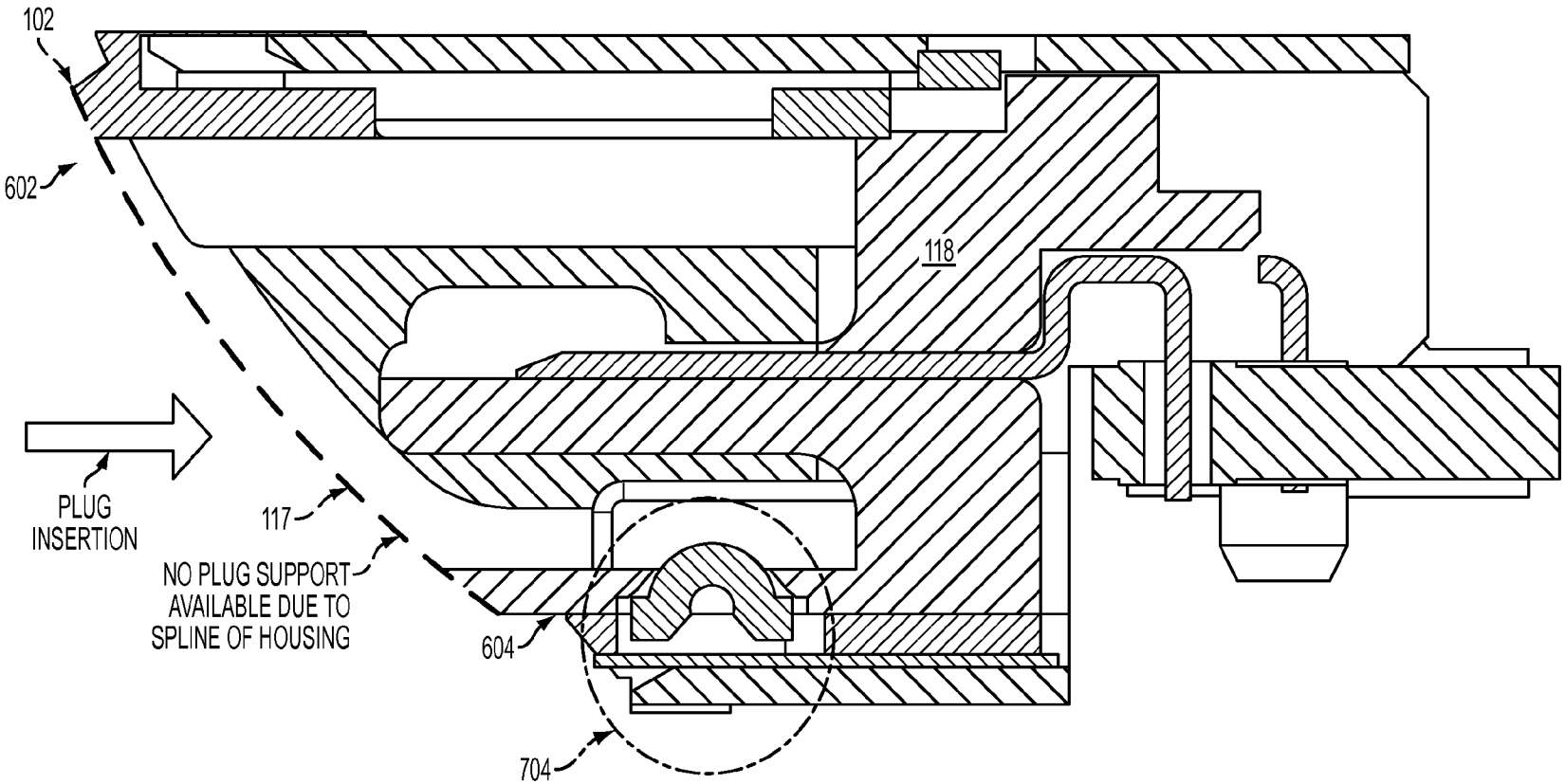
FIG. 6 shows a cross sectional view of connector assembly showing the relationship of connector assembly and the spline shape of housing.
Figure 7:
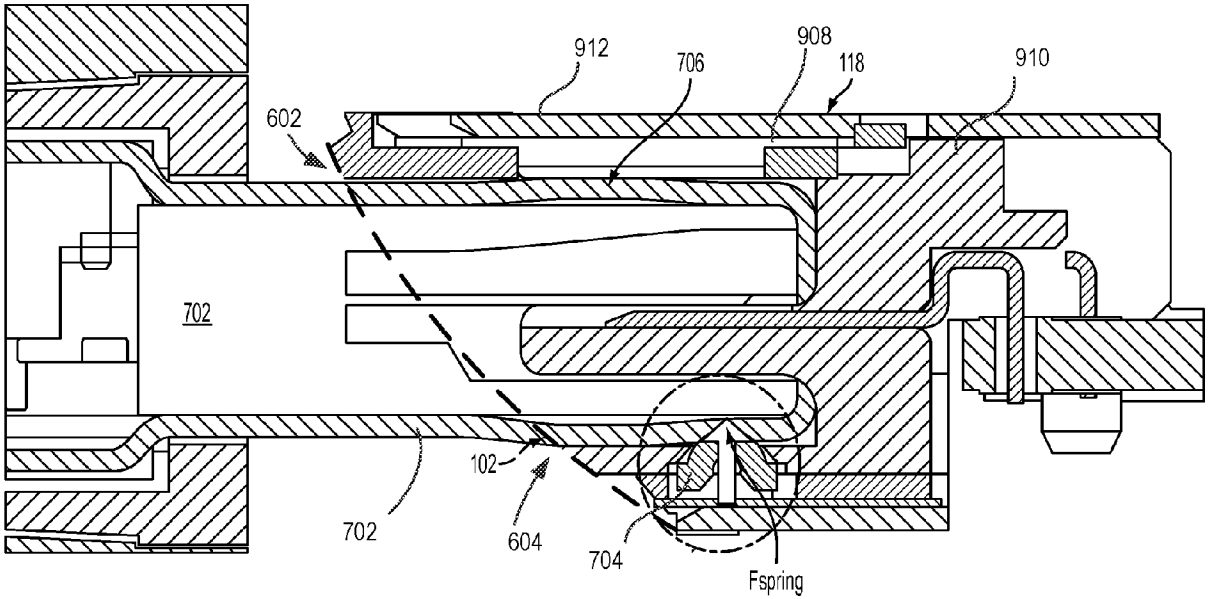
FIG. 7 shows a cross sectional view of connector assembly showing the relationship of connector assembly and the spline shape of housing with inserted connector plug.

FIG. 6 shows a cross sectional view of connector assembly 118 showing the relationship of connector assembly 118 and the spline shape of housing 102. As can be seen, due to the shape of housing 102, the portion of connector 118 has a limited depth of engagement with regards to housing 102. For example, top portion 602 can accommodate more of a connector plug than bottom portion 604. Due to this reduced amount of support, ground tabs on a connector plug cannot make an adequate electrical connection with ground contacts that would otherwise be available at bottom portion 604. Therefore, as shown in FIG. 7, in order to maintain at least four ground connections between connector plug 702 and connector assembly 118, at least two springs activated ground contacts 704 can be provided at bottom portion 604 of connector assembly 118. In the described embodiment, spring activated ground contacts can take the form of dimples 704 formed of highly conductive material along the lines of stainless steel, copper, and so forth. In addition to spring activated dimples 704, at two additional leaf type contacts 706 can be provided at top portion 602. In this way, at least four EMI ground tabs can be provided by connector assembly 118. In order to assure that overall contact resistance is minimized in spite of the reduced contact area presented by dimples 704, spring force Fspring can be in the range of about 150 grams or thereabout. Dimples 704 can protrude through a plastic body of connector assembly 118 and make contact with metal housing of plug 702 shown in FIG. 8.

Figure 8:
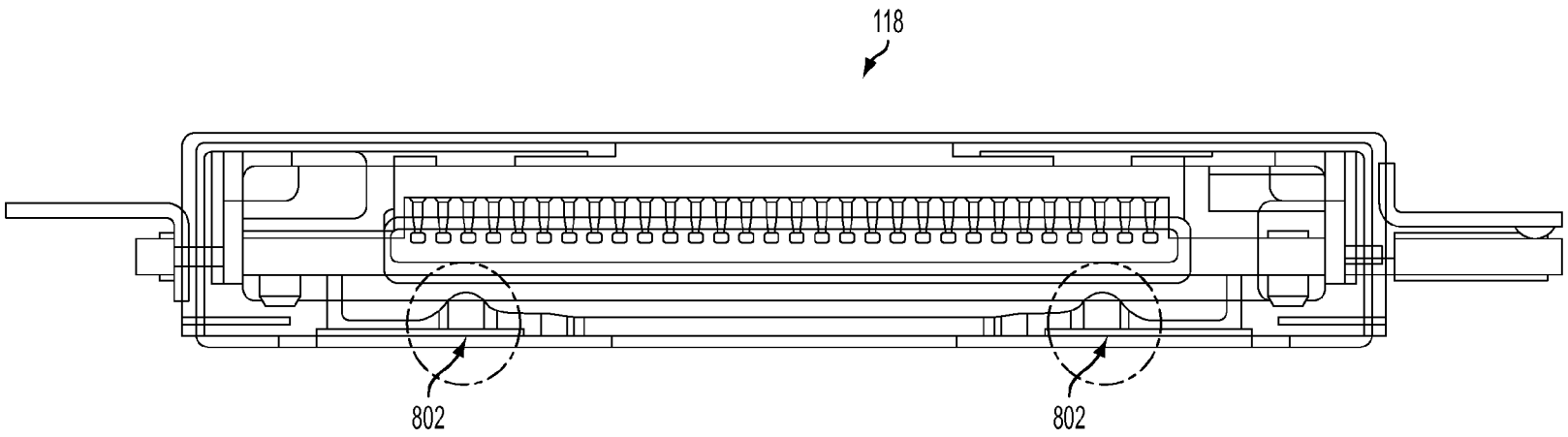
FIG. 8 shows interior view of connector assembly showing contact pads associated with spring activated dimples.

FIG. 8 shows an interior head on view of connector assembly 118 showing contact pads 802 corresponding to dimples 704. Contact pads 802 make direct contact with the metal shell of plug 702.

Figure 9A:
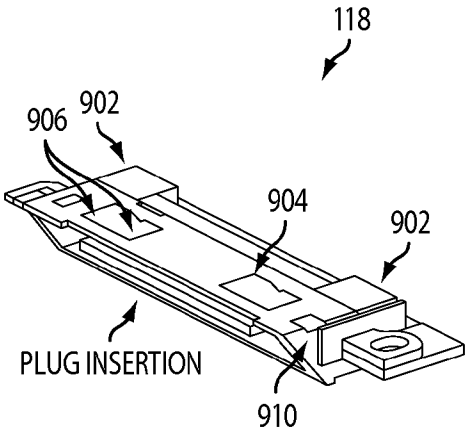
FIG. 9A-9C shows a process for heat sealing a connector assembly in accordance with the described embodiments.
Figure 9B:
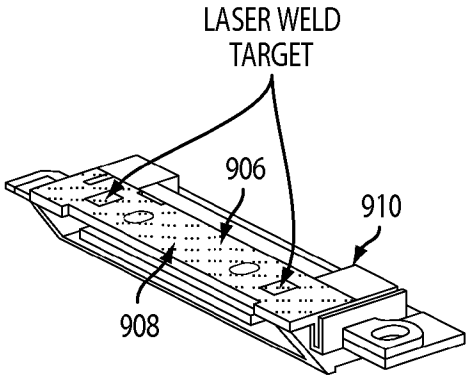
Figure 9C:
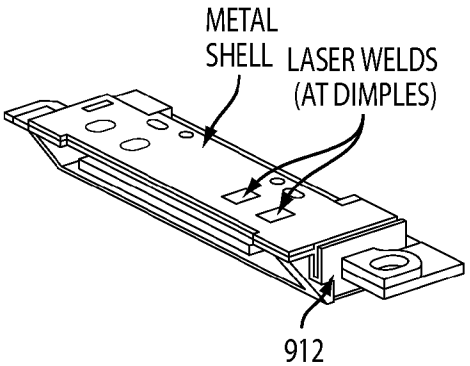

In order to assure that moisture or other liquid contaminants are inhibited from migrating from the external environment to the interior of portable media device 100, connector assembly 118 can be sealed in a manner shown in FIGS. 9A-9C. Accordingly, prior to insertion into housing 102, connector assembly 118 can be separated into a number of constituent parts (FIG. 9A). For example, window brackets 902 can engage with associated latches on a plug when inserted into and engaged with connector assembly 118. Therefore, in the partially dis-assembled condition electrical contacts 904 are readily accessible. It should be noted that electrical contacts 904 can include a flat pad portion and an upraised portion, referred to as dimple 906. In order to seal connector assembly 118 against water intrusion, sealing tape 908 can be overlaid electrical contacts 904 and housing 910. Once properly placed, sealing tape 908 can be adhered to electrical contacts 904 and housing 910 thereby sealing connector assembly 118 from water intrusion (FIG. 9B). In one embodiment, sealing tape 908 can take the form a film impregnated with heat sensitive adhesive. Therefore, by applying an appropriate amount of heat, the heat sensitive adhesive can liquefy and flow over the surface of housing 910 and electrical contacts 904. In one implementation, the heat process can take the form of a hot iron press operation having the result that sealing tape 908 adheres to both electrical contacts 904 and housing 910.

It should be noted, however, the dimples 906 can remain substantially exposed since they poke through sealing tape 908. By leaving at least a portion of dimples 906 exposed, metal shell 912 can be slid over and welded to connector assembly 118 at the exposed portions of dimples 906 (FIG. 9C).

Figure 10:
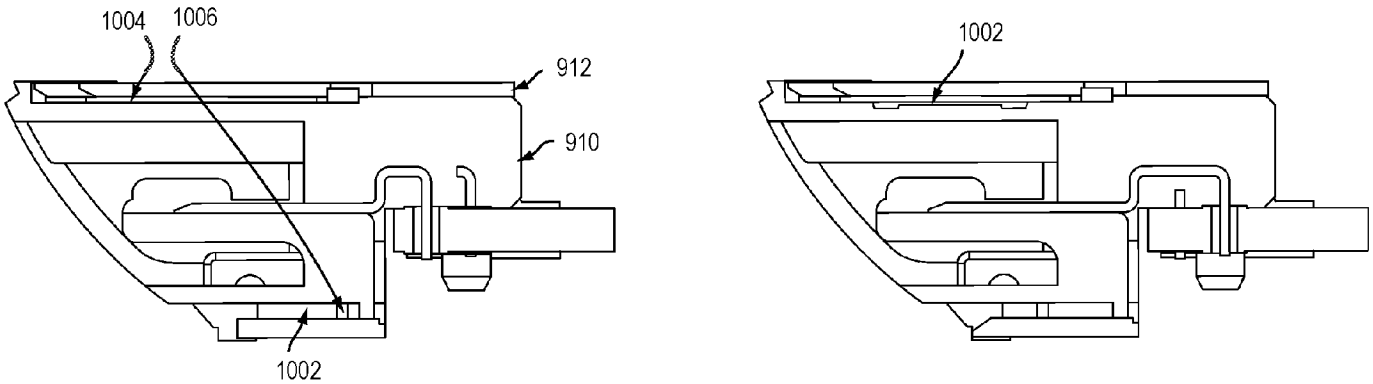
FIG. 10 shows a heat sealed connector assembly.

FIG. 10 shows a cross section of connector assembly 118 in accordance with the described embodiments. Assembly 118 shows weld locations 1002 through sealing tape 908 and the relative position of top seal 1004 and bottom seal 1006 sealing both top portion 1008 and 1010, respectively, of connector assembly 118.

Figure 11:
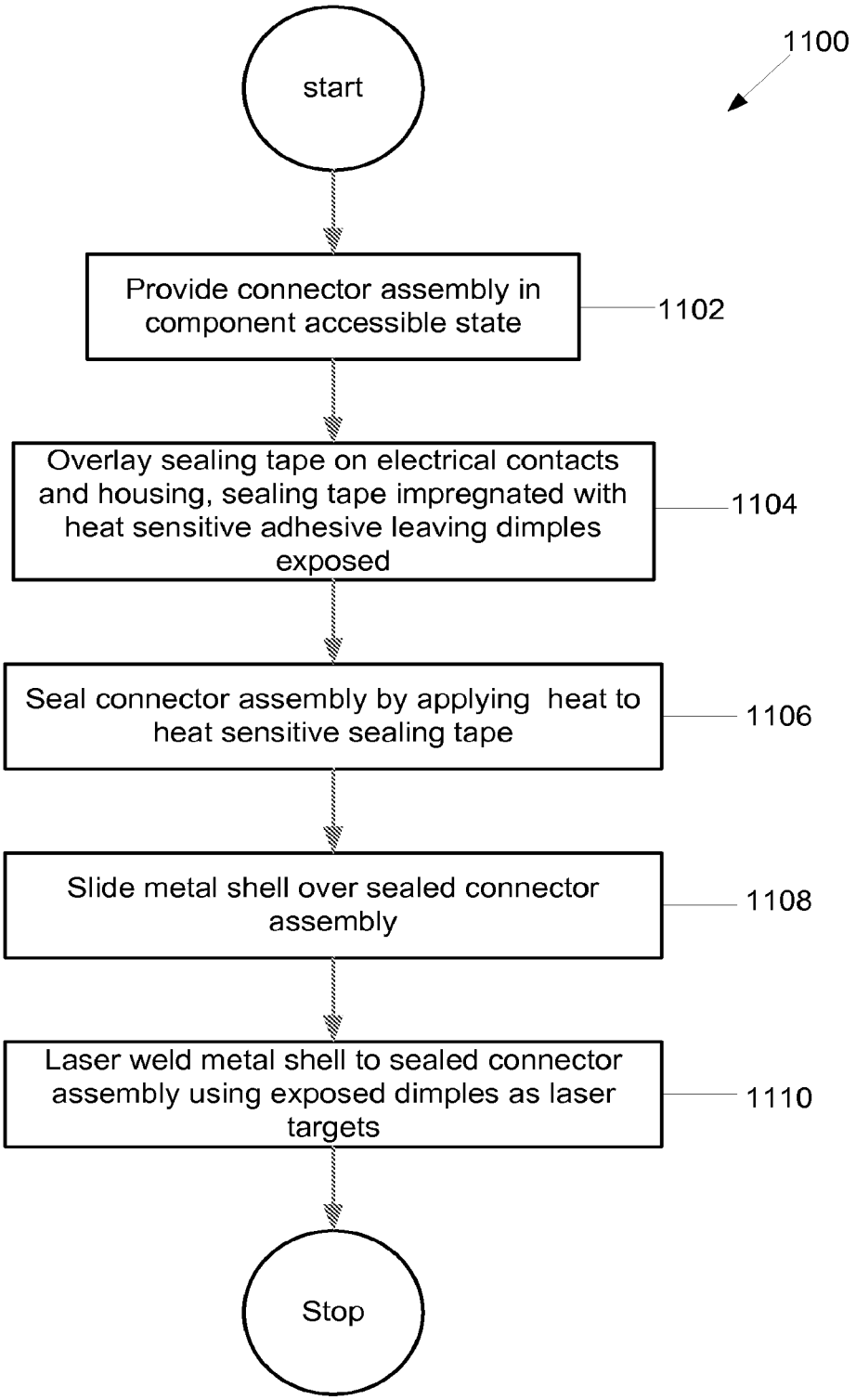
FIG. 11 is a block diagram of an arrangement of functional modules utilized by a portable media device.

FIG. 11 shows a flowchart detailing process 1100 in accordance with the described embodiments. Process 1100 can be performed by providing a connector assembly in a component accessible state. By component accessible state it is meant that the connector assembly is partially dis-assembled so as to provide access to specific components such as electrical contacts. At 1104, a sealing film is overlaid the electrical contacts and housing. The contacts having a flat pad portion in direct contact with a surface of the housing of the connector assembly and an upraised dimple portion. In the described embodiment, the sealing film can take the form of tape impregnated with heat sensitive adhesive. It should be noted that the sealing tape overlays and covers the flat pad portion of the electrical contact and a portion of the housing in proximity to the flat portion providing a first seal. Once the sealing tape is properly placed, the connector assembly undergoes a heating process at 1106 that exposes the sealing tape to sufficient heat to cause the heat sensitive adhesive to at least partially liquefy and attach sealing tape to both the flat portion of the electrical contact and the housing. At 1108, a metal shell is placed around the sealed connector assembly and is secured to the housing by laser welding using the exposed dimples as targets.

Figure 12:
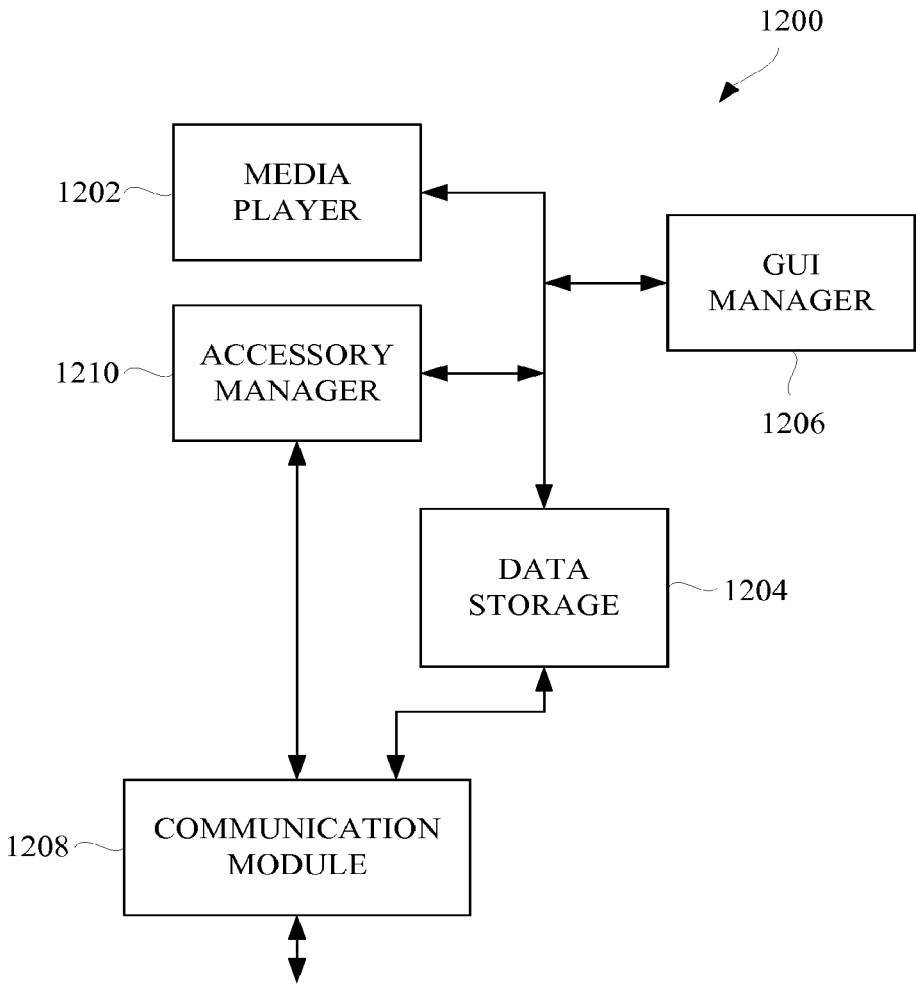
FIG. 12 is a block diagram of a media player suitable for use with the described embodiments.

FIG. 12 is a block diagram of an arrangement 1100 of functional modules utilized by a portable media device. The portable media device can, for example, be portable media device 102 illustrated in FIGS. 1 and 2. The arrangement 1100 includes a media player 1102 that is able to output media for a user of the portable media device but also store and retrieve data with respect to data storage 1104. The arrangement 1100 also includes a graphical user interface (GUI) manager 1106. The GUI manager 1106 operates to control information being provided to and displayed on a display device. The arrangement 1100 also includes a communication module 1108 that facilitates communication between the portable media device and an accessory device. Still further, the arrangement 1100 includes an accessory manager 1110 that operates to authenticate and acquire data from an accessory device that may be coupled to the portable media device. For example, the accessory device can be a wireless interface accessory, such as the wireless interface accessory 106 illustrated in FIG. 1 as being coupled to portable media device 102.

Figure 13:
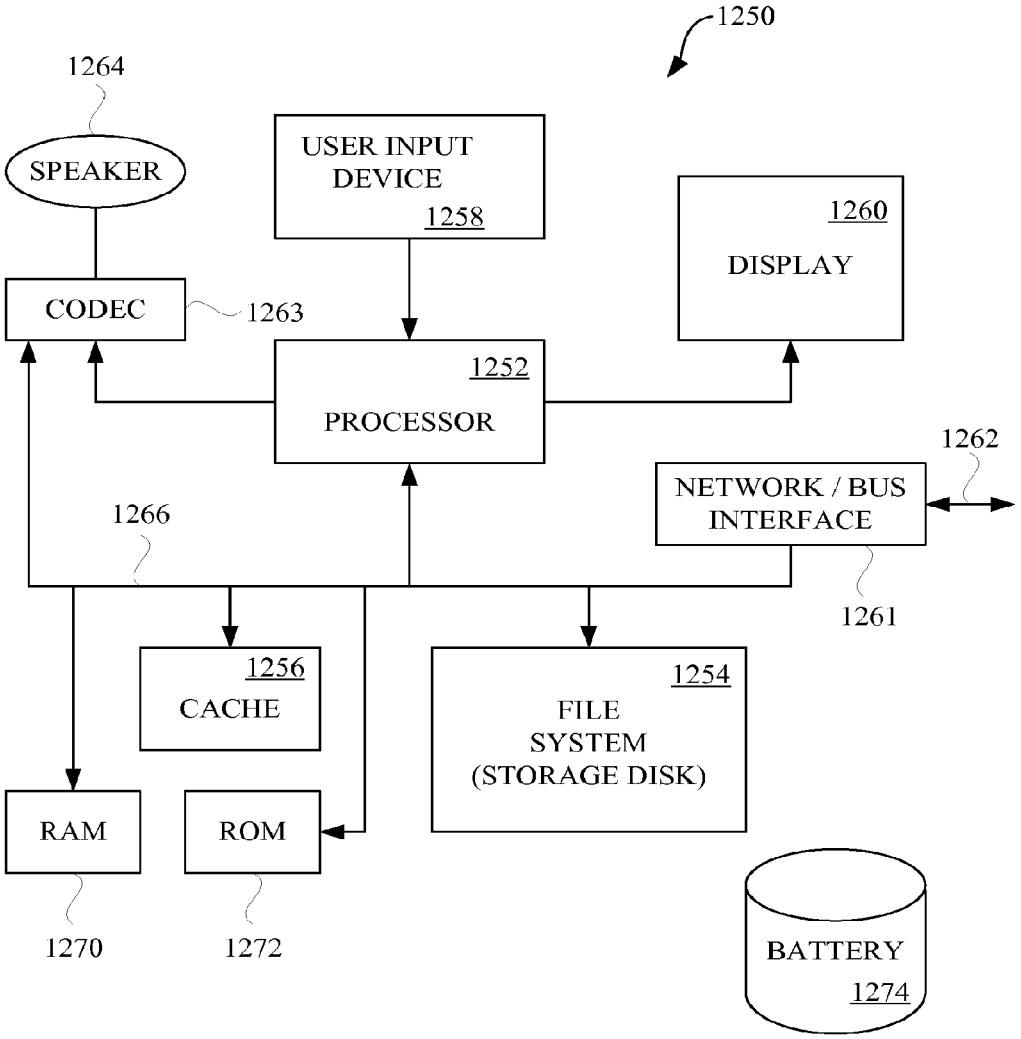
FIG. 13 shows a block diagram of a sample media player.

FIG. 13 is a block diagram of a media player 1150 suitable for use with the described embodiments. The media player 1150 illustrates circuitry of a representative portable media device. The media player 1150 includes a processor 1152 that pertains to a microprocessor or controller for controlling the overall operation of the media player 1150. The media player 1150 stores media data pertaining to media items in a file system 1154 and a cache 1156. The file system 1154 is, typically, a storage disk or a plurality of disks. The file system 1154 typically provides high capacity storage capability for the media player 1150. However, since the access time to the file system 1154 is relatively slow, the media player 1150 can also include a cache 1156. The cache 1156 is, for example, Random-Access Memory (RAM) provided by semiconductor memory. The relative access time to the cache 1156 is substantially shorter than for the file system 1154. However, the cache 1156 does not have the large storage capacity of the file system 1154. Further, the file system 1154, when active, consumes more power than does the cache 1156. The power consumption is often a concern when the media player 1150 is a portable media device that is powered by a battery 1174.

The media player 1150 can also include a RAM 1170 and a Read-Only Memory (ROM) 1172. The ROM 1172 can store programs, utilities or processes to be executed in a non-volatile manner. The RAM 1170 provides volatile data storage, such as for the cache 1156.

The media player 1150 also includes a user input device 1158 that allows a user of the media player 1150 to interact with the media player 1150. For example, the user input device 1158 can take a variety of forms, such as a button, keypad, dial, touch screen, audio input interface, video/image capture input interface, input in the form of sensor data, etc. Still further, the media player 1150 includes a display 1160 (screen display) that can be controlled by the processor 1152 to display information to the user. A data bus 1166 can facilitate data transfer between at least the file system 1154, the cache 1156, the processor 1152, and the CODEC 1163.

In one embodiment, the media player 1150 serves to store a plurality of media items (e.g., songs, podcasts, etc.) in the file system 1154. When a user desires to have the media player play a particular media item, a list of available media items is displayed on the display 1160. Then, using the user input device 1158, a user can select one of the available media items. The processor 1152, upon receiving a selection of a particular media item, supplies the media data (e.g., audio file) for the particular media item to a coder/decoder (CODEC) 1163. The CODEC 1163 then produces analog output signals for a speaker 1164. The speaker 1164 can be a speaker internal to the media player 1150 or external to the media player 1150. For example, headphones or earphones that connect to the media player 1150 would be considered an external speaker.

The media player 1150 also includes a network/bus interface 1161 that couples to a data link 1162. The data link 1162 allows the media player 1150 to couple to a host computer or to accessory devices. The data link 1162 can be provided over a wired connection or a wireless connection. In the case of a wireless connection, the network/bus interface 1161 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or video content.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a non-transitory computer readable medium. The computer readable medium is defined as any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. An electrical connector assembly, comprising:

a plurality of electrical contacts enclosed in a bracket, each of the plurality of electrical contacts having a flat pad portion and an upraised portion in the form of a dimple, wherein at least one dimple is spring activated and forms a ground tab; and a metal housing, the metal housing welded to the bracket using at least one dimple as a target for the weld.

2. The electrical connector assembly of claim 1, wherein the bracket is arranged to engage a latch on a connector plug when the connector plug is inserted into and engages the electrical connector assembly.

3. The electrical connector assembly of claim 1, wherein the electrical connector assembly is overlaid with a sealing film impregnated with a heat sensitive adhesive.

4. The electrical connector assembly of claim 3, wherein the sealing film overlays a housing, the flat pad portion of at least some of the electrical contacts and at least a portion of the dimples while enabling an upper part of the dimples to remain exposed.

5. The electrical connector assembly of claim 1, further comprising:

a spring mechanism, wherein the spring mechanism is adapted to attach to one of the dimples, and wherein the spring mechanism imparts a spring force onto the dimple when a connector plug is inserted into the electrical connector assembly.

6. The electrical connector assembly of claim 1, wherein the spring activated dimple forms a ground path between the inserted connector plug and the device housing.

7. A moisture sealed electrical connector assembly, comprising:

a plurality of electrical contacts having a flat pad portion and an upraised portion in the form of a dimple, wherein the dimple is spring activated and forms a ground tab;

a bracket adapted to engage a connector plug when the connector plug is inserted into the electrical connector assembly, wherein the electrical connector assembly is heat sealed using sealing film having a heat sensitive adhesive and wherein the sealing film overlays the housing, the flat pad portion of one or more of the plurality of electrical contacts and at least a portion of the dimple of one or more of the plurality of electrical contacts such that an upper part of the dimple of the one or more plurality of electrical contacts remains exposed; and a housing coupled to a bracket using at least one exposed dimple, wherein the sealing film prevents moisture passing from the external environment, via the electrical contacts, to the interior of the housing.

8. The moisture sealed electrical connector assembly of claim 7, wherein the moisture sealed electrical connector assembly is disposed within an opening in the housing.

9. The moisture sealed electrical connector assembly of claim 8, wherein the electrical connector assembly is inserted into the opening in the housing, wherein the housing has a curved shape such that a top portion of the housing provides greater support for the electrical connector assembly than does a bottom portion of the housing.

10. The moisture sealed electrical connector assembly of claim 9, further comprising:

a spring mechanism attached to a corresponding dimple, wherein the spring mechanism imparts a spring force onto the dimple when a connector plug is inserted into the electrical connector assembly.

11. The moisture sealed electrical connector assembly of claim 10, wherein the dimple forms a ground path between the inserted connector plug and the housing.

12. An electrical connector assembly comprising:

a plurality of electrical contacts, wherein at least one electrical contact of the plurality of electrical contacts has a flat pad portion and an upraised portion in the form of a dimple, the dimple extending at least partially through a sealing film disposed on the flat pad portion;

at least one bracket adapted to engage a connector plug when the connector plug is inserted into the electrical connector assembly; and a housing coupled to the bracket.

13. The electrical connector assembly of claim 12, further comprising:

a metal shell positioned over the housing, the metal shell having an opening corresponding to the dimple of the at least one electrical contact, wherein the metal shell is coupled to the housing by targeting the exposed portion of the dimple of the at least one electrical contact.

14. The electrical connector assembly of claim 12, wherein the dimple is formed of electrically conductive material.

15. The electrical connector assembly of claim 12, wherein the electrical connector assembly is positioned within an opening disposed on the housing.

16. The electrical connector assembly of claim 15, wherein the electrical connector is secured to the housing.

17. The electrical connector assembly of claim 12, wherein the housing has a curved shape to provide support for securing the electrical connector at a top portion of the housing.

18. The electrical connector assembly of claim 12, wherein the dimple is spring activated.

* * * * *